United States Patent [19]

Detty et al.

[11] 4,329,284

[45] May 11, 1982

[54] 1,2-OXACHALCOGENOL-1-IUM SALTS

[75] Inventors: Michael R. Detty; Thomas E. Goliber; Bruce J. Murray; Jerome H. Perlstein, all of Rochester, N.Y.

[73] Assignee: Eastman Kodak Company, Rochester, N.Y.

[21] Appl. No.: 226,341

[22] Filed: Jan. 19, 1981

[51] Int. Cl.[3] ..... G03G 5/06

[52] U.S. Cl. ..... 260/239 R; 430/900; 430/74; 430/83

[58] Field of Search ..... 430/83, 74, 900; 260/239 R

[56] References Cited

U.S. PATENT DOCUMENTS 4,046,950 9/1977 Isett ..... 260/239 R

OTHER PUBLICATIONS

Jean-Louis Piette et al., Chemica Scripta, 8A, p. 117, 1975.

*Primary Examiner*—John D. Welsh

*Attorney, Agent, or Firm*—John R. Everett

[57] ABSTRACT

1,2-oxachalcogenol-1-ium salts are presented. A novel method for making the salts is also presented. The salts are useful in improving the quantum efficiency of organic photoconductive compositions containing organic donor compounds having photoconductive properties.

17 Claims, No Drawings

1,2-OXACHALCOGENOL-1-IUM SALTS

This invention relates to novel 1,2-oxachalcogenol-1-ium salts, novel methods for making such salts and their utility as acceptors in donor-containing photoconductive compositions and elements.

A great number of chalcogen-containing organic compositions of matter are known. However, no 1,2-oxachalcogenol-1-ium salts in which the chalcogen element is tellurium or selenium have been made available. As far as can be determined, no method has been available for making such compounds.

SUMMARY OF THE INVENTION

The present invention provides novel 1,2-oxachalcogenol-1-ium salts in which the chalcogen element is tellurium or selenium. This invention also provides a method for making the salts. The salts are useful as acceptors in increasing the sensitivity of organic photoconductive compositions containing organic donor compounds having photoconductive properties such as triarylamines.

Organic photoconductive compositions in which the salts of the present invention are useful exhibit good spectral sensitivity in that portion of the ultraviolet and visible spectra extending from about 300 to about 500 nanometers (nm). When mixed with organic donors, the salts of the present invention have high quantum efficiency. They are therefore effective in improving the sensitivity of donor-containing photoconductive compositions.

The novel method of our invention comprises the steps of:

treating a 3-alkyl- or a 3-arylchalcogenoacryloyl halide with a Friedel-Crafts catalyst and isolating the resulting 1,2-oxachalcogenol-1-ium halide.

The halide anion of the thus obtained 1,2-oxachalcogenol-1-ium halide is then optionally converted to another anion by any of the simple, well-known ion-exchange techniques. Representative interchangeable anions include cyanate, isocyanate, acetate, tetrafluoroborate, perchlorate, methanesulfonate and p-toluenesulfonate.

Generally, the sensitizing activity of the salts of this invention is not affected by the type of anionic group employed. The selection of suitable anions is influenced, however, by several factors including (1) ease of synthesis and isolatibility of the salt, (2) stability of the salt, (3) compatibility of the salt with the composition in which it is incorporated, (4) solubility of the salt, etc.

PREFERRED EMBODIMENTS

In a preferred embodiment, the 1,2-oxachalcogenol-1-ium salts of the present invention have the structure II below and are prepared by treating a 3-alkyl- or a 3-arylchalcogenoacryloyl halide with a Friedel-Crafts catalyst and isolating the resulting 1,2-oxachalcogenol-1-ium halide wherein:

the 3-alkyl- or 3-arylchalcogenoacryloyl halide has structure (I):

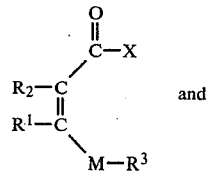

(I)

and said 1,2-oxachalcogenol-1-ium halide has the structure (II):

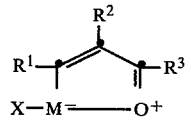

(II)

wherein:

$R^1$, $R^2$ and $R^3$ are the same or different and represent hydrogen, alkyl, aryl, or $R^1$ and $R^2$ taken together with the carbon atoms to which they are attached provide sufficient atoms to form a monocyclic or a polycyclic nonaromatic carbocyclic or heterocyclic fused ring structure having from 5 to 16 nuclear carbon atoms, M is Se to Te and X is a halide capable of forming a covalent bond.

As mentioned hereinbefore, the halide ion can be converted to another anion by any of the well-kown ion-exchange techniques.

The compound represented by Structure II is a hybrid of various resonance forms. This means that a compound covered in Structure II can have one or more electronic structures. These various structures are said to resonate to form some hybride structure which is more energy-stable than the individual resonance structures.

Nonaromatic fused rings include rings having hetero atoms such as O, N, S, Se and Te. "Alkyl" refers to a branched- or straight-chain hydrocarbon having up to 16 carbon atoms, such as methyl, butyl, dodecyl, nonyl and isobutyl; "aryl" refers to phenyl, naphthyl and anthryl. The carbocyclic and heterocyclic fused rings, alkyl and aryl are optionally further substituted with substituents such as allyl, aryl, halogen, nitro, cyano, carboxy, hydroxy, alkoxy, aryloxy, aralkyl, acyl, amide, sulfonamide, dialkylamine and amino.

DETAILED PRESENTATION OF THE INVENTION

The 3-alkyl- and 3-arylchalcogenoacryloyl halide starting materials used for making the compounds of this invention are readily prepared according to the procedure described by D. H. Wadsworth and M. R. Detty, *Journal of Organic Chemistry,* Vol 45, 4611–4615 (1980), using the appropriate precursors followed by conversion to the halide by standard procedures for converting acids to acid halides. Other procedures involved have been described by D. H. Reid and R. G. Webster, *J Chem Soc Perkin I,* 2097 (1975); J-L Piette, P. Thibaur and M. Renson, *Tetrahedron,* 34, 655 (1978); J-L Piette, P. Thibaur and M. Renson, *Chem Scr,* 8A, 117 (1975); and P. L. Dupont, O. Dideberg, J. Lamotte and J-L Piette, *Acta Cryst,* B35, 849 (1979).

Useful Friedel-Crafts catalysts include aluminum chloride ($AlCl_3$), aluminum bromide ($AlBr_3$), zinc chloride ($ZnCl_2$), zinc bromide ($ZnBr_2$) and sodium tetrachloroaluminate ($NaAlCl_4$). Aluminum chloride is the preferred catalyst.

In general, the acryloyl halide starting materials are treated in a halogenated solvent such as methylene chloride, preferably in an inert atmosphere. The temperature of the solution is maintained at or below 0° C. Then from 0.1 to 1.1 equivalents of the selected Friedel-Crafts catalyst are added to the solution. The temperature of the solution is raised to about 25° to 40° C. to allow the reaction to proceed to formation of the the novel 1,2-oxachalcogenol-1-ium halide. After the reaction is completed, the reaction mixture is cooled to room temperature.

The novel 1,2-oxachalcogenol-1-ium salts are isolated from the reaction mixture and purified using conventional chemical separation methods and techniques for isolating and purification of chemical compounds. Such methods and techniques include drowning the crude reaction mixture with cold water, removing the product by extraction with a water-immiscible solvent such as a halogenated solvent, drying, precipitation by concentration, and recrystallization from an organic solvent such as methanol when the products are solids, or separating chromatographically when the products are liquids.

The novel method of this invention was carried out for the preparation of 1,2-oxatellurol-1-ium and 1,2-oxaselenol-1-ium salts as follows:

The 3-alkyl- or 3-arylchalcogenoacryloyl chloride derivatives were dissolved in methylene chloride (1 g/10 ml) under a nitrogen atmosphere. The resulting solution was cooled to −78° C. Then 1:1 equivalents of aluminum chloride were added. The cooling bath was removed and the reaction was warmed to room temperature. The reaction mixture was poured into ice water and the products were extracted with methylene chloride. The combined methylene chloride extracts were dried over sodium sulfate and concentrated. Solid residues were recrystallized from methanol. Oils were purified by chromatography on silica gel.

Table I presents salts made according to the above procedure. The structure of each compound of the table was confirmed by NMR analysis, infrared spectral analysis, mass spectral analysis and elemental analysis.

TABLE 1

| Salt | Salt Name | M | $R^1$ | $R^2$ | $R^3$ | X | mp, °C. |
|---|---|---|---|---|---|---|---|
| 1 | 3,5-diphenyl-1,2-oxatellurol-1-ium-chloride | Te | $C_6H_5$ | H | $C_6H_5$ | Cl | 104–105 |
| 2 | 3-phenyl-5-(p-toly)-1,2-oxatellurol-1-ium chloride | Te | $C_6H_5$ | H | 4-$CH_3C_6H_4$ | Cl | 127.5–128 |
| 3 | 3-phenyl-5-(p-anisyl)-1,2-oxatellurol-1-ium chloride | Te | $C_6H_5$ | H | 4-$CH_3OC_6H$ | Cl | 123.5–125.5 |
| 4 | 5-(p-acetylphenyl)-3-phenyl-1,2-oxatellurol-1-ium chloride | Te | $C_6H_5$ | H | 4-$CH_3C(=O)C_6H_4$ | Cl | 175–177 |
| 5 | 5-(1-naphthyl)-3-phenyl-1,2-oxatellurol-1-ium chloride | Te | $C_6H_5$ | H | 1-$C_{10}H_7$ | Cl | 134–135.5 |
| 6 | 3-phenyl-5-(m-tolyl)-1,2-oxatellurol-1-ium chloride | Te | $C_6H_5$ | H | 3-$CH_3C_6H_4$ | Cl | oil |
| 7 | 5-(m-fluorophenyl)-3-phenyl-1,2-oxatellurol-1-ium chloride | Te | $C_6H_5$ | H | 3-$FC_6H_4$ | Cl | 111.5–114 |
| 8 | 3,5-diphenyl-1,2-oxatellurol-1-ium fluoride | Te | $C_6H_5$ | H | $C_6H_5$ | F | 88–90 |
| 9 | 3,5-diphenyl-1,2-oxatellurol-1-ium iodide | Te | $C_6H_5$ | H | $C_6H_5$ | I | 136–136.5 |
| 10 | 3,5-diphenyl-1,2-oxatellurol-1-ium trifluoroacetate | Te | $C_6H_5$ | H | $C_6H_5$ | $CF_3CO_2$ | 140.5–142.5 |
| 11 | 5-phenyl-1,2-oxatellurol-1-ium chloride | Te | H | H | $C_6H_5$ | Cl | 96–98 |
| 12 | 5-phenyl-1,2-oxatellurol-1-ium iodide | Te | H | H | $C_6H_5$ | I | 109–110 |
| 13 | 3-methyl-5-phenyl-1,2-oxatellurol-1-ium chloride | Te | $CH_3$ | H | $C_6H_5$ | Cl | 105–106 |
| 14 | 3-phenyl-5-(o-tolyl)-1,2-oxatellurol-1-ium chloride | Te | $C_6H_5$ | H | 2-$CH_3C_6H_4$ | Cl | oil |
| 15 | 3-phenyl-5-(p-anisyl)-1,2-oxatellurol-1-ium trifluoroacetate | Te | $C_6H_5$ | H | 4-$CH_3OC_6H_4$ | $CF_3CO_2$ | 125–127 |
| 16 | 3-phenyl-5-(p-anisyl)-1,2-oxaselenol-1-ium chloride | Se | $C_6H_5$ | H | 4-$CH_3OC_6H_4$ | Cl | 174.5–175.5 |
| 17 | 3-phenyl-5-(1-naphthyl-1,2-oxaselenol-1-ium chloride | Se | $C_6H_5$ | H | 1-$C_{10}H_7$ | Cl | 133–135 |
| 18 | 3-phenyl-5-(p-tolyl)-1,2-oxatellurol-1-ium trifluoroacetate | Te | $C_6H_5$ | H | 4-$CH_3C_6H_4$ | $CF_3CO_2$ | 130–132 |

As stated previously herein, the halides produced by the method of this invention can be converted to another anion by well-known ion-exchange techniques. Many such techniques are described in the textbook *Ion-Exchange Separations in Analytical Chemistry* by Samuelson, published by John Wiley and Sons in 1963. Ion-exchange techniques include use of anion-exchange resins, anion-exchange columns and chromatography.

One method for anion-exchange includes treating the halide with a silver salt of the desired anion. Salts 10, 15 and 18 of Table I were converted to trifluoroacetates (Compounds 19, 20 and 21 of Table I) by such a procedure, as follows:

Silver trifluoroacetate (0.298 g, 1.35 mmole) was dissolved in 20 ml of dry benzene. The Table I salt (1.35 mmole) was added gradually as a powder over a 3-minute period. After the addition was complete, the reaction mixture was stirred 1 hour at room temperature. The reaction mixture was filtered through a pad of celite diatomaceous earth. The filtrate was washed with brine, dried over sodium sulfate and concentrated. The residue was recrystallized from absolute ethanol to give salts 19, 20 and 21 of Table I.

Salt 8 of Table I was converted to the corresponding fluoride as follows:

Silver tetrafluoroborate (0.262 g, 1.34 mmole) was dissolved in 20 ml of dry acetonitrile. Compound 8 of Table I (0.50 g, 1.3 mmole) was added as a powder. The resulting solution was stirred under nitrogen for 3 hours at room temperature. The reaction mixture was filtered through a pad of celite diatomaceous earth and the filtrate was concentrated. The residue was taken up in methylene chloride, washed with brine and dried over sodium sulfate. The methylene chloride solution was concentrated under vacuum to give the yellow fluffy salt 22 of Table I.

Similarly, salts 9 and 12 of Table I were converted to iodides with sodium iodide in acetone. The chlorides are converted to the corresponding bromides with sodium bromide in acetone.

The present invention provides photoconductive compositions and elements in which organic donor-type photoconductors are combined with sensitizing amounts of the salts of the present invention. These compositions and elements are useful in electrophotographic processes. Such processes employ a photoconductive element comprising a support material having a coating containing a photoconductive material. The element is first given a uniform surface charge after a suitable period of dark adaptation. The element is then exposed to a pattern of actinic radiation which has the effect of differentially reducing the potential of the surface charge in accordance with the relative energy contained in various parts of the radiation pattern. The differential surface charge or electrostatic latent image remaining on the element is then made visible by contacting the surface with a suitable electroscopic marking material. Such marking material or toner, whether contained in an insulating liquid or on a dry carrier, are deposited on the exposed surface in accordance with either the charge pattern or the absence of charge pattern as desired. The deposited marking material is then either permanently fixed to the surface of the sensitive element by known means such as heat, pressure and solvent vapor, or transferred to a second element to which it is similarly fixed. Similarly, the electrostatic latent image can be transferred to a second element and developed there.

The compositions are generally prepared by blending a dispersion or solution of the donor type photoconductor together with an electrically insulating, film-forming resin binder, when necessary or desirable, and coating the compositions on a support or forming a self-supporting layer with the photoconductive composition. Generally, a sensitizing amount of the acceptor compound is mixed with the photoconductive coating composition so that, after thorough mixing, the sensitizing acceptor compound is uniformly distributed throughout a layer formed from the composition. The amount of sensitizer which can be added to a photoconductive composition layer to give effective increases in sensitivity can vary widely. The optimum concentration in any given case will vary with the specific donor and salt acceptor used.

In general, an appropriate salt is added in a concentration range from about 0.0001 to about 30 percent by weight based on the weight of the film-forming coating composition. Generally, the salt is added to the coating composition in an amount from about 0.005 to about 10 percent by weight of the total coating composition.

The salts used in this invention are effective for enhancing the photosensitivity of a wide variety of donor-type photoconductors. Useful photoconductors are described below.

(1) arylamine photoconductors including substituted and unsubstituted arylamines, diarylamines, nonpolymeric triarylamines and polymeric triarylamines such as those described in U.S. Pat. Nos. 3,240,597 by Fox issued Mar. 15, 1966, and 3,180,730 by Klupfel et al issued Apr. 27, 1965;

(2) polyarylalkane photoconductors of the types described in U.S. Pat. Nos. 3,274,000 by Noe et al issued Sept. 20, 1966, 3,542,547 by Wilson issued Nov. 24, 1970, and 3,542,544 by Seus et al issued Nov. 24, 1970;

(3) 4-diarylamino-substituted chalcones of the types described by Fox, U.S. Pat. No. 3,526,501 issued Sept. 1, 1970;

(4) nonionic cycloheptenyl compounds of the types described by Looker, U.S. Pat. No. 3,533,786 issued Oct. 13, 1970;

(5) compounds containing an:

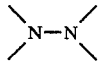

nucleus, as described by Fox, U.S. Pat. No. 3,542,546 issued Nov. 24, 1970;

(6) organic compounds having a 3,3'-bisaryl-2-pyrazoline nucleus, as described by Fox et al, U.S. Pat. No. 3,527,602 issued Sept. 8, 1970;

(7) triarylamines in which at least one of the aryl radicals is substituted by either a vinyl radical or a vinylene radical having at least one active hydrogen-containing group, as described by Brantly et al, U.S. Pat. No. 3,567,450 issued Mar. 2, 1971;

(8) triarylamines in which at least one of the aryl radicals is substituted by an active hydrogen-containing group, as described by Brantly et al, Belgian Pat. No. 728,563 dated Apr. 30, 1969;

(9) any other organic donor compound which exhibits photoconductive properties such as those set forth in Australian Pat. No. 248,402 and the various polymeric photoductors such as the photoconductive carbazol polymers described in U.S. Pat. No. 3,421,891 issued Jan. 14, 1969.

Preferred binders for use in preparing the photoconductive layers which can be sensitized in accordance with the method of this invention comprise polymers having fairly high dielectric strength which are good electrically insulating film-forming vehicles. Materials of this type comprise styrene-butadiene copolymers; silicone resins; styrene-alkyd resins; silicone-alkyd resins; soyaalkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals) such as poly(vinyl butyral); polyacrylic and methacrylic esters such as poly(methyl methacrylate), poly(n-butyl methacrylate), poly(isobutyl methacrylate), etc.; polystyrene; nitrated polystyrene; polymethylstyrene; isobutylene polymers; polyesters such as poly(ethylene alkylenebis(aryleneoxyalkylene) terephthalate) such as poly(ethylene-co-2,2'-isopropylidenebisphenyleneoxymethylene) terephthalate; phenolformaldehyde resins; ketone resins; polyamides; polycarbonates; polythiocarbonates; 2,2'-isopropylidenebis(phenyleneoxyethylene); nuclear-substituted poly(vinyl haloarylates), etc. Methods of making resins of this type have been described in the prior art; for example, styrene-alkyd resins are prepared according to the method described in U.S. Pat. Nos. 2,361,019 and 2,258,423. Suitable resins of the type contemplated for use in the photoconductive layers of the invention are sold under such trademarks as Vitel PE-101, Cymac, Piccopale 100, Saran F-220 and Lexan 105 and 145. Other types of binders which are useful in the photoconductive layers of the invention include such materials as paraffin and mineral waxes. If a polymeric photoconductor is used, the binder may be omitted.

The organic coating solvents useful for preparing coating dopes are selected from a variety of materials. Useful liquids are hydrocarbon solvents, including substituted hydrocarbon solvents, with preferred materials being halogenated hydrocarbon solvents. The requisite properties of the solvent are that it be capable of dissolving the acceptor and capable of dissolving or at least highly swelling or solubilizing the polymeric ingredient of the composition. In addition, it is helpful if the solvent is volatile, preferably having a boiling point of less than about 200° C. Particularly useful solvents include halogenated lower alkanes having from 1 to about 3 carbon atoms such as dichloromethane, dichloroethane, dichloropropane, trichloromethane, trichloroethane, tribromomethane, trichlorofluoromethane, trichlorotrifluoroethane, etc.; aromatic hydrocarbons such as benzene, toluene, as well as halogenated benzene compounds such as chlorobenzene, bromobenzene, dichlorobenzene, etc.; ketones such as dialkyl ketones having 1 to about 3 carbon atoms in the alkyl moiety such as dimethyl ketone, methyl ethyl ketone, etc.; and ethers such as tetrahydrofuran, etc. Mixtures of these and other solvents are also useful.

In preparing the photoconductive coating composition, useful results are obtained where the donor is present in an amount equal to at least about 1 weight percent of the coating composition. The upper limit in the amount of donor present can be widely varied in accordance with usual practice. In those cases where a binder is employed, it is generally required that the donor be present in an amount from about 1 weight percent of the coating composition to about 99 weight percent of the coating composition. A polymeric donor can be employed, in which case an additional binder may not be required. A preferred weight range for the donor substance in the coating composition is from about 10 weight percent to about 60 weight percent.

Suitable supporting materials for coated photoconductive layers which are sensitized in accordance with the method of this invention can include any of a wide variety of electrically conducting supports, for example, paper (at a relative humidity above 20 percent); aluminum-paper laminates; metal foils such as aluminum foil and zinc foil; metal plates such as aluminum, copper, zinc, brass and galvanized plates; vapor-deposited metal layers such as silver, nickel and aluminum coated on paper or conventional photographic film bases such as cellulose acetate and polystyrene. Such conducting materials as nickel can be vacuum-deposited on transparent film supports in sufficiently thin layers to allow electrophotographic elements prepared therewith to be exposed from either side of such elements. An especially useful conducting support is prepared by coating a support material such as poly(ethylene terephthalate) with a conducting layer containing a semiconductor dispersed in a resin. Such conducting layers both with and without insulating barrier layers are described in U.S. Pat. No. 3,245,833. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 and 3,262,807.

Coating thicknesses of the photoconductive composition on the support can vary widely. Generally, a coating in the range of about 10 microns to about 300 microns before drying is useful for the practice of this invention. The preferred range of coating thickness is found to be in the range from about 50 microns to about 150 microns before drying, although useful results are obtained outside this range. The resultant dry thickness of the coating is preferably between about 2 microns and about 50 microns, although useful results are obtained with a dry coating thickness between about 1 and about 200 microns.

The elements of the present invention are employed in any of the well-known electrophotographic processes which require photoconductive layers and elements. In one such process, a photoconductive element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation, for example, by a contact-printing technique, or by lens projection of an image to form a latent electrostatic image in the photoconductive layer. Exposing the surface in this manner forms a pattern of electrostatic charge by virtue of the fact that light energy striking the photoconductor causes the electrostatic charge in the light-struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive particles having optical density. The developing electrostatically responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush toner applicator are described in U.S. Pat. No. 2,786,439 by Young, 2,786,440 by Giaimo and 2,786,441 by Young, all issued Mar. 26, 1957, and 2,874,063 by Greig issued Feb. 17, 1959. Liquid development of the latent electrostatic image is also useful. In liquid development, the developing particles are carried to the image-bearing surface in an electrically insulating liquid carrier. Methods of development of this type are widely known and have been described in the patent literature, for example, Metcalfe et al, U.S. Patent No. 2,907,674 issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. In other cases, a transfer of the electrostatic charge image formed on the photoconductive layer is made to a second support such as paper which then becomes the final print after development and fusing. Techniques of the type indicated are well-known in the art and have been described in the literature in RCA Review, Volume 15 (1954), pages 469–484.

EXAMPLES 1–9

The following illustrative examples show the use of the salts, of the present invention as acceptors in electrophotographic elements. Each film was formulated and coated as follows. Fifteen mg of the Table 1 salt and 215 mg of tri-p-tolylamine were dissolved in 3 ml of dichloromethane. To this solution were added 4 ml of dichloromethane containing 12.5% Lexan-145 TM (General Electric) by weight. The solution was stirred for several minutes and then coated at 0.006 mil wet thickness on a poly(ethylene terephthalate) support containing 0.4 OD evaporated nickel. After initial evaporation of the solvent, the films were dried 24 hr in air at 60° C. Dry thickness was about 7 μm.

The quantum efficiency of each film was measured as follows. Samples were corona-charged to a surface potential equivalent to the field strengths, $E_o$, indicated in Table 2. They were then exposed to monochromatic radiation at $\lambda = 350$ nm with a bandwidth of 10 nm. The incident photon flux at 350 nm was measured with an Optronics Laboratories Model 730-A Radiometer. Films were allowed to discharge while exposed to the 350-nm radiation. The initial quantum efficiency (the number of electron-hole pairs produced per incident photon) at field strength $E_o$ was then determined by computation of the slope of the discharge curve at $E_o$. The photodischarge sensitivity at 350 nm, $S_{\frac{1}{2}}$, was also determined by allowing the films to discharge from $E_o$ to $E_o/2$. The amount of radiation necessary to produce this discharge was then calculated from the time required for this half-decay and the incident photon flux.

Table 2 shows the initial quantum efficiencies ($\phi_o$) at $E_o$ and photosensitivity ($S_{\frac{1}{2}}$) for nine different photoconductive elements of the present invention. For the compounds of this invention, the major effect is an increase of initial quantum efficiency as much as a factor of 10 and a photosensitivity increase of as much as 20 over films not containing a salt of the present invention. The increased quantum efficiency was obtained in most cases with only 2% by weight of the Table 1 salt.

TABLE 2

Initial Quantum Efficiency ($\phi_o$) and Photosensitivity ($S_{\frac{1}{2}}$) for Lexan-tri-p-tolylamine Films Containing Table 1 Salts ($\lambda$ = 350 nm, Positive-Charging Front Surface Exposure)

| Example No | Table 1 Salt[a] | $E_o$ (volts/cm) | $\phi_o$ | $S_{\frac{1}{2}}$ (ergs/cm$^2$) |
|---|---|---|---|---|
| control | none | $1.6 \times 10^6$ | 0.0094 | 1500 |
| 1 | 8 | $1.1 \times 10^6$ | 0.007 | 432 |
| 2 | 11 | $7.1 \times 10^5$ | 0.014 | 179 |
| 3 | 1 | $1.6 \times 10^6$ | 0.063 | 146 |
| 4 | 3 | $1.7 \times 10^6$ | 0.066 | 144 |
| 5 | 9 | $1.3 \times 10^5$ | 0.046 | 134 |
| 6 | 12 | $1.3 \times 10^5$ | 0.038 | 100 |
| 7 | 15 | $1.6 \times 10^6$ | 0.103 | 81 |
| 8 | 16 | $1.4 \times 10^6$ | 0.0130 | 641 |
| 9 | 19[b] | $4.3 \times 10^5$ | 0.006 | 167 |

[a]Film composition by weight: 2% salt, 30% tri-p-tolylamine, 68% Lexan 145
[b]Composition: 14.8% salt, 25.6% tri-p-tolylamine, 59.6% Lexan 145

Although the invention has been described in considerable detail with particular reference to certain preferred embodiments thereof, variations and modifications can be effected within the spirit and scope of the invention.

We claim:

1. A method of making 1,2-oxachalcogenol-1-ium halide compositions of matter in which the chalcogen element is tellurium or selenium comprising the steps of:
   treating a 3-alkyl- or a 3-arylchalcogenoacryloyl halide with a Friedel-Crafts catalyst and
   isolating the resultant 1,2-oxachalcogenol-1-ium halide.

2. A method of making 1,2-oxachalcogenol-1-ium halide compositions of matter comprising the steps of:
   treating a 3-alkyl- or a 3-arylchalcogenoacryl oyl halide with a Friedel-Crafts catalyst and
   isolating the resulting 1,2-oxachalcogenol-1-ium halide or 3-alkyl- or 3-arylchalcogenoacryloyl halide wherein:
   the 3-alkyl- or 3-arylchalcogenoacryloyl halide has structure (I):

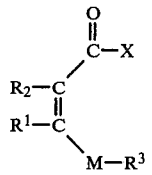

(I)

and the resulting 1,2-oxachalcogenol-1-ium halide has the structure (II):

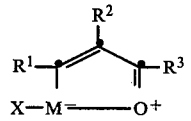

(II)

in which:

$R^1$, $R^2$ and $R^3$ are the same or different and represent hydrogen, alkyl or aryl, or $R^1$ and $R^2$ taken together with the carbon atoms to which they are attached provide sufficient atoms to form a monocyclic or a polycyclic nonaromatic carbocyclic or heterocyclic fused ring structure having from 5 to 16 nuclear carbon atoms, M is Se or Te and X is a halide group.

3. A method according to claims 1 or 2 wherein the treatment of the 3-alkyl- or 3-arylchalcogenoacryloyl halide is carried out by:
   forming a solution of said halide in a halogenated organic solvent in an inert atmosphere,
   maintaining the temperature of the solution at or below 0° C.
   adding to the mixture from 0.1 to 1.1 the molar equivalents of a Friedel-Crafts catalyst selected from the group consisting of $AlCl_3$, $AlBr_3$, $ZnCl_2$, $AnBr_2$ and $NaAlCl_4$ and
   raising the temperature of the latter mixture to 25° to 40% C. to enhance formation of the 1,2-oxochalcogenol-1-ium halide.

4. A method according to claims 1 or 2 wherein the halide group of the resulting 1,2-oxochalcogenol-1-ium halide is converted to another anion.

5. A method according to claim 4 wherein the halide group of said 1,2-oxachalcogenol-1-ium halide is converted to another anion by treating said 1,2-oxachalcogenol-1-ium halide with a silver salt of the desired anion.

6. A method as in claim 3 wherein the catalyst is $AlCl_3$.

7. A method as in claims 1 or 2 wherein X represents a chloride anion.

8. A 1,2-oxachalcogenol-1-ium salt wherein the chalcogen element is tellurium or selenium.

9. A 1,2-oxachalcogenol-1-ium salt having the structure:

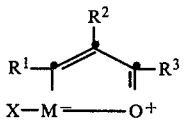

(II)

wherein:

$R^1$, $R^2$ or $R^3$ are the same or different and represent hydrogen, alkyl or aryl, or $R^1$ and $R^2$ taken together with the carbon atoms to which they are attached provide sufficient atoms to form a monocyclic or a polycyclic nonaromatic carbocyclic or heterocyclic fused ring structure having from 5 to 16 nuclear carbon atoms, M is Se or Te and X is an anion.

10. A 1,2-oxachalcogenol-1-ium salt selected from the group consisting of 3,5-diphenyl-1,2-oxatellurol-1-ium chloride, 3-phenyl-5-(p-tolyl)-1,2-oxatellurol-1-ium chloride, 3-phenyl-5-(p-anisyl)-1,2-oxatellurol-1-ium chloride, 5-(p-acetylphenyl)-3-phenyl-1,2-oxatellurol-1-ium chloride, 5-(1-naphthyl)-3-phenyl-1,2-oxatellurol-1-ium chloride, 3-phenyl-5-(m-tolyl)-1,2-oxatellurol-1-ium chloride, 5-(m-fluorophenyl)-3-phenyl-1,2-oxatellurol-1-ium chloride, 3,5-diphenyl-1,2-oxatellurol-1-ium fluoride, 3,5-diphenyl-1,2oxatellurol-1-ium iodide, 3,5-diphenyl-1,2-oxatellurol-1-ium trifluoroacetate, 5-phenyl-1,2-oxatellurol-1-ium chloride, 5-phenyl-1,2-oxatellurol-1-ium iodide, 3-methyl-5-phenyl-1,2-oxatellurol-1-ium chloride, 3-phenyl-5-(o-tolyl)-1,2-oxatellurol-1-ium chloride, 3-phenyl-5-(p-anisyl)-1,2-oxatellurol-1-ium trifluoroacetate, 3-phenyl-5-(p-anisyl)-1,2-oxaselenol-1-ium chloride, 3-phenyl-5-(1-naphthyl)-1,2-oxaselenol-1-ium chloride and 3-phenyl-5-(p-tolyl)-1,2-oxatellurol-1-ium trifluoroacetate.

11. An electrophotographic composition comprising a donor-type organic photoconductor, a sensitizing amount of a 1,2-oxachalcogenol-1-ium salt in which the chalcogen element is tellurium or selenium.

12. An electrophotographic composition comprising an organic photoconductor and a sensitizing amount of 1,2-oxachalcogenol-1-ium salt having the structure (II):

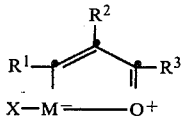

(II)

wherein:

$R^1$, $R^2$ and $R^3$ are the same or different and represent hydrogen, alkyl, aryl, or $R^1$ and $R^2$ taken together with the carbon atoms to which they are attached provide sufficient atoms to form a monocyclic or a polycyclic nonaromatic carbocyclic or heterocyclic fused ring structure having 5 to 16 nuclear carbon atoms, M is Se or Te and X is an anionic group.

13. An electrophotographic composition comprising a sensitizing amount of a 1,2-oxachalcogenol-1-ium compound selected from the group consisting of 3,5-diphenyl-1,2-oxatellurol-1-ium chloride, 3-phenyl-5-(p-tolyl)-1,2oxatellurol-1-ium chloride, 3-phenyl-5-(p-anisyl)-1,2-oxatellurol-1-ium chloride, 5-(p-acetylphenyl)-3-phenyl-1,2-oxatelluryl-1-ium chloride, 5-(1-naphthyl)-3-phenyl-1,2-oxatellurol-1-ium chloride, 3-phenyl-5-(m-tolyl)-1,2-oxatellurol-1-ium chloride, 5-(m-fluorphenyl)-3-phenyl-1,2-oxatellurol-1-ium chloride, 3,5-diphenyl-1,2-oxatellurol-1-ium fluoride, 3,5-diphenyl-1,2-oxatellurol-1-ium iodide, 3,5-diphenyl-1,2-oxatellurol-1-ium trifluoroacetate, 5-phenyl-1,2-oxatellurol-1-ium chloride, 5-phenyl-1,2-oxatellurol-1-ium iodide, 3-methyl-5-phenyl-1,2-oxatellurol-1-ium chloride, 3-phenyl-5-(o-tolyl)-1,2-oxatallurol-1-ium chloride, 3-phenyl-5-(p-anisyl)-1,2-oxatellurol-1-ium trifluoroacetate, 3-phenyl-5-(p-anisyl)-1,2-oxaselenol-1-ium chloride, 3-phenyl-5-(1-naphthyl)-1,2-oxaselenol-1-ium chloride and 3-phenyl-5-(p-tolyl)-1,2-oxatellurol-1-ium trifluoroacetate.

14. A composition as in claims 11, 12 or 13 wherein the donor-type organic photoconductor is a triarylamine.

15. A composition as in claims 11, 12 or 13 in which the donor-type organic photoconductor is tri-p-tolylamine.

16. An electrophotographic element comprising a layer containing the composition of claims 11, 12 or 13.

17. A composition as in claims 11, 12 or 13 wherein said 1,2-oxachalcogenol-1-ium compound is present in an amount in the range 0.0001 to 30 percent by weight of the composition.

* * * * *